United States Patent [19]

Sittmann

[11] 3,931,981

[45] Jan. 13, 1976

[54] ADJUSTABLE JAW, ESPECIALLY FRONT JAW, FOR SKI BINDINGS

[75] Inventor: Brigitte Sittmann, Stuttgart, Germany

[73] Assignee: Vereinigte Baubeschlagfabriken Gretsch & Co. GmbH, Leonberg, Germany

[22] Filed: May 20, 1974

[21] Appl. No.: 471,544

[30] Foreign Application Priority Data

May 25, 1973 Germany ..... 2326636

[52] U.S. Cl. ..... 280/11.35 T

[51] Int. Cl.[2] ..... A63C 9/08

[58] Field of Search ..... 280/11.35 T

[56] References Cited

UNITED STATES PATENTS

| | | | |
|---|---|---|---|
| 2,777,706 | 1/1957 | Goodman | 280/11.35 T |
| 2,788,981 | 4/1957 | Emerson | 280/11.35 T |
| 2,793,869 | 5/1957 | Braun | 280/11.35 T |

*Primary Examiner*—Robert R. Song

*Attorney, Agent, or Firm*—Craig & Antonelli

[57] ABSTRACT

An adjustable retaining jaw for ski bindings, especially a front jaw, for the support of a binding part pivotal about a horizontal axis and/or about an axis perpendicular to the ski surface, which includes a detent member subjected to spring pressure and engageable in a counter-detent member; the detent member is thereby adjustably arranged as a unit together with the detent spring keeping the same under spring pressure.

29 Claims, 2 Drawing Figures

FIG.1
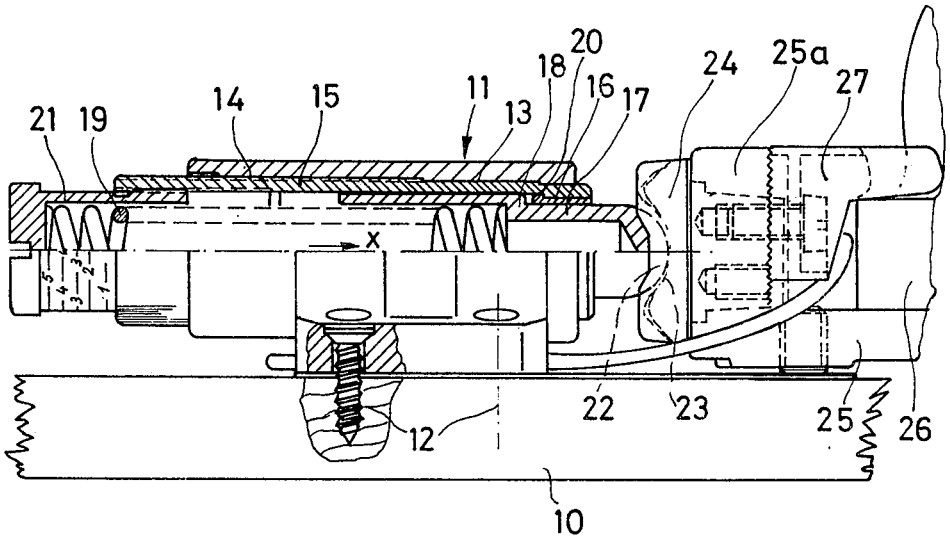
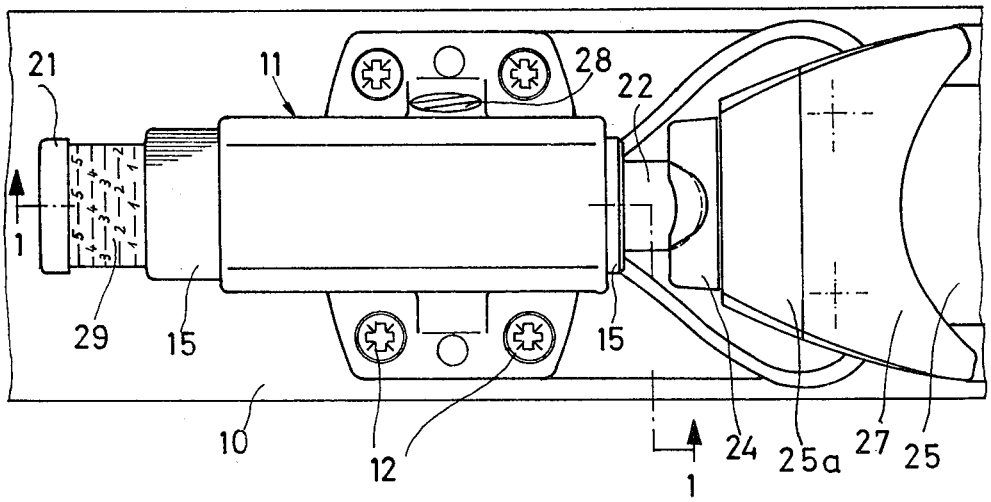
FIG.2

ADJUSTABLE JAW, ESPECIALLY FRONT JAW, FOR SKI BINDINGS

The present invention relates to an adjustable retaining or hold-down jaw for ski bindings, especially of front jaws, for the support of a binding part pivotal about a horizontal axis and/or about an axis perpendicular to the ski surface, with a detent member which is under spring pressure and engages in a counter-detent member.

For the adaptation to different shoe lengths and/or for the compensation of manufacturing inaccuracies, it is known to adjust retaining or hold-down jaws on the ski in the longitudinal direction with the use of a slide-carriage-like guidance. The adjustment takes place by means of elongated slots and clamping screws or by means of a threaded spindle. However, such an adjustability is relatively expensive from a constructive point of view.

The present invention aims above all at a simplification in the construction and in the handling with simultaneous accurate and continuous adjustability, and essentially consists in that the detent member together with the detent spring holding the same under spring pressure is adjustably arranged as a unit. Preferably, the detent member and detent spring are accommodated for this purpose in an adjusting sleeve adjustable within the retaining or hold-down jaw, preferably in the form of a threaded sleeve.

The hold-down or retaining jaw may be fixedly arranged as such at the ski by the use of the present invention in that the adjustability, especially in the ski longitudinal direction is limited essentially to the detent member and the detent spring apart from the adjusting member, for example, the threaded sleeve or bush. The prestress of the detent spring may remain uninfluenced during the adjustment in that on the inside of the adjustable unit the detent member is forced by the detent spring against an abutment, from which the detent member is lifted off or can be lifted off under the prestress produced by the detent spring, possibly only during abutment at the counter-detent member. The control of the spring prestress may thereby be undertaken independently of the longitudinal adjustment of the unit.

The detent member is preferably constructed as detent piston axially stressed by the detent spring, which detent piston is slidingly supported in the adjusting sleeve under interposition of a slide bush. For purposes of securing and fixing the adjusted position of the unit, a fixing device may be provided, in the simplest manner in the form of a clamping screw.

Accordingly, it is an object of the present invention to provide an adjustable retaining jaw, especially front jaw for ski bindings, which avoids by simple means the aforementioned shortcomings and drawbacks encountered in the prior art.

Another object of the present invention resides in an adjustable retaining jaw for ski bindings which permits an easy adjustment to compensate for different shoe lengths and/or manufacturing inaccuracies, yet is extraordinarily simple in construction and inexpensive in manufacture and assembly.

A further object of the present invention resides in an adjustable hold-down jaw for ski bindings which not only brings about a simplification in the construction, but also facilitates the operation and servicing.

Still a further object of the present invention resides in a safety ski binding of the type described above which enables accurate and continuous adjustability by simple means to enable an adjustment in the longitudinal direction of the ski without changing the prestress of the release mechanism.

These and other objects, features and advantages of the present invention will become more apparent from the following description when taken in connection with the accompanying drawing which shows, for purposes of illustration only, one embodiment in accordance with the present invention, and wherein:

FIG. 1 is a side elevational view of an adjustable retaining jaw according to the present invention, which is shown in cross section in the upper portion therof taken along line 1—1 of FIG. 2, in conjunction with a binding part retained by the retaining jaw; and FIG. 2 is a top plan view of the ski binding of FIG. 1.

Referring now to the drawing wherein like reference numerals are used throughout the two views to designate like parts, the retaining or hold-down jaw generally designated by reference numeral 11 is threadably secured on the ski 10 by means of screws 12. The retaining or hold-down jaw 11, especially a front jaw, includes a longitudinal bore 13 which is provided in part with an internal thread 14. An adjusting sleeve 15 constructed as threaded sleeve which is screwed into the thread 14, carries at its rear end a slide bush 16. The piston-like detent member 17 is slidingly supported within the slide bush 16. The detent member 17 includes a shoulder or offset 18 which is able to abut in the direction of arrow *x* (FIG. 1) against a stop or abutment 20 under the effect of the detent spring 19; the abutment or stop 20 is formed by a shoulder or collar of the slide bush 16 which, in its turn, is secured against longitudinal displacement as shown. The spring 19 is supported, on the one hand, against the shoulder 18 of the detent member 17 and, on the other, against a spring abutment 21 which is axially screwed into the threaded sleeve 15 and is adapted to be screwed in or out for purposes of changing the spring-stress.

The detent member 17 engages with its rounded-off head portion 22 in a recess 23 of a socket-like counter-detent member 24 which is adjustably arranged at the forward end face of a binding part 25, for example, in a forward support bracket **25*a* of a sole plate, to which the ski boot is fixedly clamped in any suitable manner, for example, at the forward end by means of a retaining member 27 overlapping the boot sole 26** and at the rear end by a further conventional hold-down or retaining mechanism (not illustrated), for example, by an arcuate member clamped over the heel.

Normally, the assembly of the retaining mechanism takes place as follows:

The retaining jaw 11 is secured as a unit on the ski 10 by means of the screws 12. Thereupon, the binding members 25, for example, a sole plate, is inserted together with the counter-detent member 24. If thereafter the detent member 17 is not in prescribed engagement with the counter-detent support 24, then the unit consisting of the threaded sleeve 15, the detent member 17 and the detent spring 19 together with the adjustable spring abutment 21 may be screwed in or out by screwing the threaded sleeve 15 into or out of the internal thread 14 of the front jaw 11 until the desired engaging position of the detent member 17 is reached.

The detent spring 19 is appropriately adjusted already beforehand to the requisite prestress by threaded action of the spring abutment 21 screwing the same into or out of the sleeve 15, whereby the detent member 17 abuts at the abutment collar 20 of the sliding bush 16. In the prescribed position of engagement, the shoulder 18 of the detent member 17 has appropriately a small spacing from the abutment 20 as is illustrated in FIG. 1. However, the detent spring 19 can be adjusted possibly also at any time subsequently to a desired prestress by a rotation of the spring abutment 21.

After the completed axial adjustment of the threaded sleeve 15 into the desired position, a fixing or clamping screw 28 can be tightened which engages with its inner end at the threaded sleeve 15 and thereby clamps the same fast in its adjusted position. The adjustable spring abutment 21 may be provided with a scale or markings 29, by means of which the prestress of the detent spring 19 can be read from the outside.

Instead of an adjusting sleeve, for example, also an adjusting member provided with an abutment for the detent member, which extends through the detent spring, is longitudinally adjustable in the retaining jaw and preferably includes an adjustable spring abutment, may be provided. Generally, however, an adjusting sleeve is particularly advantageous from a constructive and handling point of view.

While I have shown and described only one embodiment in accordance with the present invention, it is understood that the present invention is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. An adjustable retaining jaw for releasably connecting first and second relatively movable ski binding parts to one another, comprising:

a housing, housing connecting means for connecting said housing to said first part, a detent unit carried by said housing, said detent unit including a detent means engageable with counter-detent means at said second part and detent biasing means for biasing said detent means against said counter-detent means, and detent unit adjusting means for adjusting the position of said detent unit with respect to said counter-detent means, said detent unit adjusting means being separate from said housing connecting means, wherein said detent unit adjusting means includes a threaded sleeve which carries said detent unit, said threaded sleeve being threadably adjustable in a threaded longitudinal bore of said housing.

2. A retaining jaw according to claim 1, wherein said first part is a portion of a ski and said second part is attached to ski binding means which is pivotal about an axis.

3. A retaining jaw according to claim 2, characterized in that the ski binding means is pivotal about a horizontal axis.

4. A retaining jaw according to claim 3, characterized in that the ski binding means is pivotal about an axis substantially perpendicular to the longitudinal axis of the ski.

5. A retaining jaw according to claim 2, characterized in that the ski binding means is pivotal about an axis substantially perpendicular to the ski surface.

6. A retaining jaw according to claim 2, characterized in that the second part is attached at a front jaw for a ski binding.

7. A retaining jaw according to claim 1, wherein said threaded sleeve includes abutment means abutting said detent means, wherein said biasing means includes a biasing spring, and wherein said threaded sleeve and detent means are configured such that the biasing force of said spring can be increased by adjusting said threaded sleeve with said detent means and counter-detent means in contact with one another.

8. A retaining jaw according to claim 1, wherein said biasing means includes a spring having one end in engagement with said detent means and the other end in engagement with a threaded back-up member, said threaded back-up member being threadably adjustably carried by said threaded sleeve.

9. An adjustable retaining jaw for releasably connecting first and second relatively movable ski binding parts to one another, comprising:

a housing, housing connecting means for connecting said housing to said first part, a detent unit carried by said housing, said detent unit including a detent means engageable with counter-detent means at said second part and detent biasing means for biasing said detent means against said counter-detent means, and detent unit adjusting means for adjusting the position of said detent unit with respect to said counter-detent means, said detent unit adjusting means being separate from said housing connecting means, characterized in that the detent unit is accommodated in an adjusting sleeve means adjustable in the housing, and characterized in that the adjusting sleeve means is constructed as a threaded sleeve.

10. A retaining jaw according to claim 9, characterized in that the detent means is constructed as a detent piston axially stressed by detent spring means, the detent piston being slidingly supported in the adjusting sleeve means under interposition of a slide bush.

11. A retaining jaw according to claim 10, characterized in that the detent means is forced by the detent spring means against an abutment means on the inside of the detent unit which unit is adjustable as a whole.

12. A retaining jaw according to claim 11, characterized in that the abutment means is formed by the slide bush.

13. A retaining jaw according to claim 11, characterized in that the detent spring means is adjustable in its spring stress on the inside of the adjustable unit.

14. A retaining jaw according to claim 13, characterized in that a threaded spring abutment is provided for the adjustment of the spring stress which is adapted to be screwed into or out of the adjusting sleeve means.

15. A retaining jaw according to claim 14, characterized in that the adjusting sleeve means of the detent unit is fixable in the adjusted position within the retaining jaw.

16. A retaining jaw according to claim 15, characterized in that the adjusting sleeve means of the detent unit is adapted to be fixed in its adjusted position within the retaining jaw by means of a clamping screw.

17. A retaining jaw according to claim 16, characterized in that the abutment means is formed by the slide bush.

18. An adjustable retaining jaw for releasably connecting first and second relatively movable ski binding parts to one another, comprising:

a housing, housing connecting means for connecting said housing to said first part, a detent unit carried by said housing, said detent unit including a detent means engageable with counter-detent means at said second part and detent biasing means for biasing said detent means against said counter-detent means, and detent unit adjusting means for adjusting the position of said detent unit with respect to said counter-detent means, said detent unit adjusting means being separate from said housing connecting means, wherein said detent unit adjusting means includes means on said detent unit and on said housing which continuously interengage with one another to hold the detent unit in respective adjusted positions with respect to said housing, even against the force of said biasing means, at all times during adjustment of the position of said detent unit.

19. A retaining jaw according to claim 18, characterized in that the detent unit is accommodated in an adjusting sleeve means adjustable in the housing.

20. A retaining jaw according to claim 19, characterized in that the detent means is constructed as a detent piston axially stressed by detent spring means, the detent piston being slidingly supported in the adjusting sleeve means under interposition of a slide bush.

21. A retaining jaw according to claim 19, characterized in that a threaded spring abutment is provided for the adjustment of the spring stress of said detent biasing means which is adapted to be screwed into or out of the adjusting sleeve means.

22. A retaining jaw according to claim 19, characterized in that the adjusting sleeve means of the detent unit is fixable in the adjusted position within the retaining jaw.

23. A retaining jaw according to claim 19, characterized in that the adjusting sleeve means of the adjustable unit is adapted to be fixed in its adjusted position within the retaining jaw by means of a clamping screw.

24. A retaining jaw according to claim 18, characterized in that the detent means is forced by detent spring means against an abutment means on the inside of the unit adjustable as a whole, said detent spring means forming said detent biasing means.

25. A retaining jaw according to claim 18, characterized in that detent spring means forming said detent biasing means is adjustable in its spring stress on the inside of the detent unit.

26. A retaining jaw according to claim 18, characterized in that the detent unit is fixable in the adjusted position within the housing.

27. A retaining jaw according to claim 18, characterized in that the detent unit is adapted to be fixed in its adjusted position within the housing by means of a clamping screw.

28. A retaining jaw according to claim 18, wherein detent force adjusting means are provided for adjusting the biasing force said biasing means exerts against said detent means, and wherein said detent unit adjusting means is separate from said detent force adjusting means.

29. A retaining jaw according to claim 28, wherein said first part is a portion of a ski and said second part is attached to ski binding means which is pivotal about an axis.

* * * * *